US005232744A

United States Patent [19]

Nakamura et al.

[11] Patent Number: 5,232,744

[45] Date of Patent: Aug. 3, 1993

[54] ELECTROLESS COMPOSITE PLATING BATH AND METHOD

[75] Inventors: Takayuki Nakamura; Tadashi Chiba, both of Hirakata, Japan

[73] Assignee: C. Uyemura & Co., Ltd., Osaka, Japan

[21] Appl. No.: 658,660

[22] Filed: Feb. 21, 1991

[51] Int. Cl.[5] ..... C23C 26/00

[52] U.S. Cl. ..... 427/437; 427/443.1; 106/1.27

[58] Field of Search ..... 427/304, 306, 437, 443.1 C; 106/1.27

[56] References Cited

U.S. PATENT DOCUMENTS

| | | | |
|---|---|---|---|
| 3,024,134 | 3/1962 | Nixon | 106/1.27 |
| 3,360,397 | 12/1967 | Koretzky | 106/1.27 |
| 3,677,907 | 7/1972 | Brown | 106/1.27 |
| 3,723,078 | 3/1973 | Parker | 427/443.1 C |
| 3,940,512 | 2/1976 | Christini | 427/304 |
| 4,061,802 | 12/1977 | Costello | 106/1.27 |
| 4,136,216 | 1/1979 | Feldstein | 427/304 |
| 4,160,049 | 7/1979 | Narcus | 427/306 |
| 4,368,223 | 1/1983 | Kobayashi | 106/1.27 |
| 4,448,811 | 5/1984 | Doty | 427/306 |
| 4,716,059 | 12/1987 | Kim | 427/443.1 |
| 4,830,889 | 5/1989 | Henry | 427/437 |

FOREIGN PATENT DOCUMENTS 732136 4/1966 Canada ..... 427/306

OTHER PUBLICATIONS

J. M. Odekerken "Use of Co-Deposited Non-Conducting Materials to Improve the Corrosion Resistance of Nickel-Chromium Electrodeposits" Electroplating and Metal Finishing, Jan., 1964, pp. 2-11.

Nathan Feldstein "Electroless (Autocatalytic) Plating" Metal Finishing Guidebook and Directory, 1981, pp. 504, 506, 508, 510, 512.

G. G. Gawrilov "Chemical (Electroless) Nickel Plating" Portcullis Press 1979, pp. 18-25, 36-39, 164-167.

*Primary Examiner*—Shrive Beck

*Assistant Examiner*—Vi Duong Dang

*Attorney, Agent, or Firm*—Birch, Stewart, Kolasch & Birch

[57] ABSTRACT

A composite film consisting of particles of fibers dispersed in a metal matrix and formed by electroless deposition can be improved in appearance and particle or fiber content by adding a water-soluble amine or ammonium salt to the electroless plating bath. Preferably the bath contains a water-soluble nickel or cobalt salt, a hypophosphite reducing agent, a chelating agent for chelating the nickel or cobalt ion, a surface active agent, water-insoluble particles or fibers typically of polytetrafluoroethylene, and the water-soluble amine or ammonium salt.

9 Claims, No Drawings

ELECTROLESS COMPOSITE PLATING BATH AND METHOD

This invention relates to an electroless composite plating bath and method capable of forming a composite film of uniform color tone.

BACKGROUND OF THE INVENTION

In the prior art, it is known to disperse particles or fibers of polytetrafluoroethylene, or other water-insoluble materials in an electroless nickel plating bath containing sodium hypophosphite as a reducing agent. The chemical plating forms a composite film having the particles or fibers codeposited and dispersed in the nickel matrix. In order to enable the dispersion of the particles or fibers in the bath and the code position of the particles or fibers from such an electroless plating bath having a sodium hypophosphite reducing agent, surface active agents must be added to the bath. These surface active agents, however, can lead to the formation of electroless composite films having an irregular color tone stripe, particularly when fluorinated particles or fibers are codeposited.

In order to increase the amount of particles or fibers that are codeposited in the composite film, there is not known any effective means other than increasing the amount of particles or fibers dispersed in the bath.

SUMMARY OF THE INVENTION

Therefore, an object of the present invention is to provide a novel and improved electroless or chemical plating bath and method capable of forming a composite film which exhibits aesthetic outside appearance including even luster and tone, despite the presence of a surface active agent in the bath, and has a higher content of the particles or fibers codeposited.

The inventors made experiments using an electroless composite plating bath which contains a hypophosphite salt reducing agent, a surface active agent, and particles or fibers of polytetrafluoroethylene or the like. They have found that when an amine such as diethylamine or an ammonium salt such as ammonium sulfate is added to the bath, there is obtained a composite film that is free of any irregular luster or tone stripe. That is, the film has an even outside appearance. Moreover, the addition of an amine or ammonium salt can significantly increase the content of particles or fibers codeposited in the film, as compared with the bath having the same amount of particles or fibers dispersed therein but free of an amine or ammonium salt.

According to a first aspect of the present invention, there is provided an electroless plating bath for the electroless deposition of a composite film consisting essentially of a metal matrix and water-insoluble particles or fibers dispersed therein, comprising per liter of the bath, 0.05 to 0.5 mol of a water-soluble metal salt, 0.1 to 0.5 mol of a water-soluble hypophosphite salt as a reducing agent, 0.1 to 1 mol of a chelating agent for chelating the metal ion of the water-soluble metal salt, 0.001 to 10 grams of a surface active agent, 0.1 to 500 grams of water-insoluble particles or fibers, the particles having an average particle size of 0 .05 to 100 μm and the fibers having a length of 0.1 to 1,000 μm, and 1 to 200 grams of a water-soluble amine or ammonium salt, the bath being at pH 4 to 8.

According to a second aspect of the present invention, there is provided an electroless plating method comprising the step of dipping a workpiece in the electroless plating bath defined above, thereby forming a composite film consisting essentially of the water-insoluble particles or fibers codeposited and dispersed in a metal matrix on the workpiece.

DETAILED DESCRIPTION OF THE INVENTION

The electroless composite plating bath of the invention contains a water-soluble metal salt. The bath is best adapted for depositing films of nickel, nickel alloys such as Ni.P, Ni.B, Ni.Co.B, Ni.W.P, Ni.Cu.P, and Ni.W.B, all containing at least 50% by weight, preferably at least 75% by weight of nickel, cobalt, and cobalt alloys such as Co.P and Co.B, all containing at least 50% by weight, preferably at least 75% by weight of cobalt. To this end, the bath should contain a water-soluble salt of nickel or cobalt and, optionally, another alloying element or elements if it is desired to deposit a nickel or cobalt alloy. Preferred water-soluble salts include sulfates, chlorides, nitrides, fluoroborates and sulfamates.

The bath uses a reducing agent in the form of a hypophosphite salt such as hypophosphite alkali metal salts, typically sodium hypophosphite.

The bath further contains a chelating agent for chelating the metal ion of the water-soluble metal salt, for example, organic acids and metal salts thereof. Examples of the organic acids and metal salts thereof include mono. carboxylic acids, dicarboxylic acids, tricarboxylic acids and sodium and potassium salts thereof, such as sodium acetate, sodium citrate, sodium succinate, and malic acid.

The bath generally contains 0.05 to 0.5 mol/liter, especially 0.05.to 0.25 mol/liter of the metal salt, 0.1 to 1 mol/liter, especially 0.1 to 0.5 mol/liter of the chelating agent, and 0.05 to 1 mol/liter, especially 0.1 to 0.5 mol/liter of the reducing agent. The bath is generally adjusted to pH 4 to 8 although the bath is preferably acidic.

The electroless plating bath further contains a surface active agent which may be selected from anionic, cationic, nonionic, and ampholytic surface active agents and mixtures thereof. Exemplary anionic surface active agents include alkylbenzenesulfonic acids and water-soluble salts thereof, alkyl sulfates, alkyl ether sulfates, alkylphenyl ether sulfates. Exemplary cationic surface active agents include water-soluble quaternary ammonium salts, alkyl pyridinium salts, imidazolines, aliphatic amine salts, fluorocarbon cationic surface active agents, and secondary and tertiary amines. Exemplary nonionic surface active agents include water-soluble polyoxyethylene type nonionic surface active agents, polyethyleneimine type nonionic surface active agents, and ester type nonionic surface active agents. Exemplary ampholytic surface active agents include water-soluble carboxylic acid type ampholytic surface active agents and sulfonic acid type ampholytic surface active agents. Among them, fluorocarbon cationic surface active agents such as perfluoroalkylammonium iodide are preferred in promoting the dispersion and code position of water-insoluble particles or fibers.

The surface active agent is generally added in an amount of 0.001 to 10 grams/liter, especially 0.01 to 0.5 grams/liter of the bath. Although composite films resulting from an electroless plating system containing such a surface active agent often have an irregular outside appearance as typified by a stripe of varying tone as previously mentioned, this problem can be avoided by the addition of an amine or ammonium salt according to the present invention.

If desired the bath may further contain stabilizers and other additives which are commonly used in conventional electroless plating baths.

Dispersed in the bath are water insoluble particles or fibers. The particles or fibers may be selected in accordance with a particular application of the composite film. Examples are particles and fibers of fluoro resins such as polytetrafluoroethylene and polydifluoroethylene; fluorinated compounds such as fluorinated graphite; and inorganic materials including nitrides such as boron nitride, silicon nitride, and titanium nitride, carbides such as silicon carbide, chromium carbide ($Cr_3C_2$), boron carbide, and titanium carbide, oxides such as vanadium oxide, titanium oxide, and aluminum oxide, sulfides such as molybdenum disulfide, and borides such as tungsten boride, titanium boride, and zirconium boride. According to the present invention, there is deposited through a chemical plating process composite films of uniform appearance having the particles or fibers uniformly codeposited in substantial amounts.

The particles or fibers are generally dispersed in the bath in an amount of 0.1 to 500 grams/liter, preferably 1 to 10 grams/liter. The particles or fibers may be of dimensions as found in conventional composite plating baths. Most often, the particles have a particle size of from 0.05 to 100 μm, preferably from 0.1 to 10 μm. The fibers have a length of from 0.1 to 1,000 μm, preferably from 1 to 20 μm.

The feature of the present invention is to add an amine or an ammonium salt to the electroless plating bath defined above, thereby enabling formation of a composite film of good uniform appearance having an increased content of particles or fibers codeposited therein.

The amines and ammonium salts may be used alone or as a mixture of two or more amines, a mixture of two or more amines, and a mixture of an amine and an ammonium salt. Examples of the amine include monoalkylamines, dialkyl, amines, and trialkylamines in all of which the alkyl group having 1 to 5 carbon atoms, ethylenediamine, tetramethylene, diamine, hexamethylenediamine, pentamethylenediamine, and heptamethylenediamine. Examples of the ammonium salt include ammonium sulfate, ammonium chloride, ammonium secondary phosphate, and ammonium citrate. Preferred are diethylamine, triethylenediamine, ammonium sulfate, and ammonium secondary citrate.

The amine or ammonium salt is generally added to the bath in an amount of 1 to 200 grams/liter, preferably 10 to 100 grams/liter.

The plating method of the present invention may follow conventional electroless plating methods. A workpiece or article is dipped in the bath which is set under conventional plating conditions. Generally, the plating temperature is in the range of from 50 to 95° C., preferably from 70 to 90° C. The plating time depends on the desired thickness of a film to be deposited, which generally ranges from 0.3 to 1,000 μm, most often from 3 to 50 μm. The type and shape of workpiece on which composite films can be deposited is not particularly limited. There may be used any materials on which metal films can chemically deposit, for example, steel, ferrous alloys, stainless steel, copper, copper alloys, nickel, nickel alloys, aluminum, aluminum alloys, and metallized plastics (e.g. ABS resins).

Although electroless composite plating films resulting from an electroless plating system containing a surface active agent often suffered from an irregular outside appearance such as striped tone particularly when the particles or fibers codeposited are of fluorinated compounds, the addition of an amine or ammonium salt according to the present invention ensures the formation of composite films of uniform appearance having a higher content of particles or fibers codeposited.

EXAMPLE

Examples of the present invention are given below by way of illustration and not by way of limitation.

EXAMPLE 1

Using an electroless plating bath of the following composition, a composite nickel film was deposited on a steel plate.

| Bath | grams/liter |
|---|---|
| Polytetrafluoroethylene (mean particle size 1 μm) | 25 |
| Surface active agent* | 1.25 |
| Nickel chloride | 16 |
| Sodium hypophosphite | 24 |
| Sodium succinate | 16 |
| Malic acid | 18 |
| Diethylamine | 10 |
| Plating conditions | |
| pH | 5.5 |
| Temperature | 93° C. |

*Perfluoroalkyl ammonium iodide available under the trade name FC-135C from Sumitomo 3M K.K.

There was obtained a nickel film having polytetrafluoroethylene particles codeposited therein which appeared to have uniform tone and be free of any irregularity. The amount of polytetrafluoroethylene particles codeposited was 15% by volume.

Equivalent results were obtained when the diethylamine was replaced by ammonium sulfate.

For comparison purposes, electroless plating was carried out in a bath of the same composition as Example 1 except that the diethylamine was omitted. There was obtained a nickel film which appeared to have stripes of different tone. The amount of polytetrafluoroethylene codeposited was 5% by volume.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. An electroless plating bath for the electroless deposition of a composite film consisting essentially of a metal matrix and water-insoluble particles or fibers dispersed therein, comprising, per liter of the bath:

0.05 to 0.5 mol of a water-soluble metal salt, 0.01 to 0.5 mol of a water-soluble hypophosphite salt as a reducing agent, 0.01 to 1 mol of a chelating agent for chelating the metal ion of said water-soluble metal salt, 0.001 to 10 grams of a surface active agent, 0.1 to 500 grams of water-insoluble particles or fibers, the particles having an average particle size of 0.05 to 100 μm and the fibers having a length of 0.1 to 1,000 μm, and 1 to 200 grams of ammonium sulfate; and wherein said bath has a pH from 4 to 8.

2. The bath of claim 1 wherein said metal salt is a salt of nickel, nickel alloy, cobalt or cobalt alloy.

3. The bath according to claim 1, wherein the surface active agent is a fluorocarbon cationic surface active agent.

4. The bath according to claim 1, wherein the water-insoluble particles or fibers are comprised of a fluoro resin.

5. The bath of claim 1 wherein the water-insoluble particles or fibers are comprised of fluorinated carbon.

6. A method for the electroless deposition of a composite film consisting essentially of a metal matrix having water-insoluble particles or fibers dispersed therein, comprising: dipping a workpiece into the electroless plating bath as claimed in claim 1, for a sufficient duration so as to deposit said composite film.

7. The bath according to claim 1, wherein said ammonium sulfate is contained in an amount of 10 to 100 grams/liter of bath.

8. The bath according to claim 4, wherein the water-insoluble particles or fibers are comprised of polytetrafluoroethylene.

9. The bath according to claim 1, wherein the water-insoluble particles have a particle size of 0.1 to 10 μm and the water-insoluble fibers have a length of 1 to 20 μm.

* * * * *